US006617050B2

(12) United States Patent
Chao

(10) Patent No.: US 6,617,050 B2
(45) Date of Patent: Sep. 9, 2003

(54) LOW DENSITY AND HIGH DUCTILITY ALLOY STEEL FOR A GOLF CLUB HEAD

(75) Inventor: Chih-Yeh Chao, Pingtung (TW)

(73) Assignee: O-Ta Precision Casting Co., Ltd., Pingtung Hsien (TW)

( * ) Notice: Subject to any disclaimer, the term of this patent is extended or adjusted under 35 U.S.C. 154(b) by 0 days.

(21) Appl. No.: 09/981,728

(22) Filed: Oct. 19, 2001

(65) Prior Publication Data

US 2003/0077479 A1 Apr. 24, 2003

(51) Int. Cl.[7] ..... C22C 38/38; C21D 8/00; A63B 53/04

(52) U.S. Cl. ..... 428/687; 420/74; 148/337; 148/619; 473/349

(58) Field of Search ..... 428/687; 148/337, 148/619; 420/74; 473/349

(56) References Cited

U.S. PATENT DOCUMENTS 4,847,046 A * 7/1989 Kim et al. ..... 420/76
4,875,933 A * 10/1989 Wan ..... 75/10.17
4,975,335 A * 12/1990 Wan ..... 428/610
5,094,383 A * 3/1992 Anderson et al. ..... 228/176
5,167,733 A * 12/1992 Hsieh ..... 148/522

FOREIGN PATENT DOCUMENTS

JP 02-291878 * 12/1990
JP 05-212526 * 8/1993
JP 10-216275 * 8/1998
JP 2002-180205 * 6/2002

OTHER PUBLICATIONS

Derwent Abstract for TW 460591 A, published Oct. 21, 2001, one page.*

* cited by examiner

*Primary Examiner*—John J. Zimmerman
(74) *Attorney, Agent, or Firm*—Rosenberg, Klein & Lee

(57) ABSTRACT

An alloy for golf club head include by weight 25 to 31 wt % manganese, 6.3 to 7.8 wt % aluminum, 0.65 to 0.85 wt % carbon and 5.5 to 9.0 wt % chromium, and the balance being iron. Additions of 0.8 to 1.5 wt % silicon, 2.0 to 5.0 wt % titanium, or 0.5 to 1.0 wt % molybdenum are optionally included in the alloy. Due to the chromium, titanium and molybdenum, the alloy has a good resistance to corrosion, a good finished surface quality after being forged at a temperature from 800° C. to 1050° C. A combination of high ductility and high tensile strength is achieved after the alloy has been treated at a temperature from 980° C. to 1080° C. for 1 to 24 hours.

3 Claims, 12 Drawing Sheets

| Code | Composition | | | | | | | |
|---|---|---|---|---|---|---|---|---|
| | Fe | Mn | Al | C | Cr | Si | Ti | Mo |
| 1 | Bal. | 26.50 | 6.85 | 0.69 | 5.67 | | | |
| 2 | Bal. | 28.42 | 6.93 | 0.73 | 7.03 | 0.95 | | |
| 3 | Bal. | 30.15 | 6.95 | 0.84 | 8.05 | 1.41 | 2.15 | |
| 4 | Bal. | 29.51 | 7.24 | 0.70 | 6.04 | | | |
| 5 | Bal. | 30.25 | 7.33 | 0.76 | 7.15 | 0.84 | | |
| 6 | Bal. | 29.20 | 7.40 | 0.82 | 8.15 | 1.20 | 3.5 | |
| 7 | Bal. | 27.45 | 7.80 | 0.69 | 5.87 | | 4.01 | |
| 8 | Bal. | 28.52 | 7.77 | 0.75 | 6.98 | 0.88 | | 0.67 |
| 9 | Bal. | 29.53 | 7.75 | 0.81 | 8.07 | 1.02 | 4.89 | |
| 10 | Bal. | 29.13 | 7.25 | 0.81 | 8.92 | 1.38 | 3.01 | 0.95 |
| 11 | Bal. | 29.35 | 7.91 | 0.84 | | | | |
| 12 | Bal. | 29.15 | 9.89 | 1.03 | | | | |
| 13 | Bal. | 28.97 | 7.23 | 0.79 | 3.15 | | | |
| 14 | Bal. | 30.19 | 7.53 | 0.72 | 4.89 | | | |
| 15 | Bal. | 29.39 | 7.25 | 0.79 | 9.56 | | | |

*Code 11, 12, 13, 14 are examples for comparison.

| FEATURE | Dewaxing casting | Forging |
|---|---|---|
| Controllability | Low | Good |
| Sweet spot | Small | Big |
| Strike distance | Less | Farther |
| Variety of CG | Less | Good |
| Torque | Less | Big |
| Softness | Less | Middle |
| Accuracy | Less | Good |
| Stability | Less | Good |

Fig. 1

| Mode | Code | Y. S. (ksi) | U. T. S. (ksi) | Elongation (%) | Density ($g/cm^3$) | Hardness | Remark |
|---|---|---|---|---|---|---|---|
| Casting | 17-4PH | 87 | 123 | 23 | 7.8 | HRc30 | 1030℃ 1Hour+720℃ 5Hour |
| | 431SS | 94 | 107 | 22 | 7.7 | HRc20 | 720℃ 3Hour |
| | 255SS | 97 | 110 | 14 | 7.8 | HRc25 | 1060℃ 1Hour |
| | 304SS | 30 | 75 | 40 | 8.0 | $R_B$88 | 1030℃ 1Hour |
| | Ti | 62 | 70 | 18 | 4.5 | | |
| | Ti-5Al-4V | 125 | 135 | 12 | 4.5 | | |
| Forging | 304SS | 32 | 72 | 64 | | | |
| | S25C | 44 | 80 | 31 | 7.9 | $R_B$ | |
| | Ti-6Al-4V | 153 | 163 | 14 | 4.5 | | |

Fig. 2

| Code | Fe | Al | Mn | C | Others |
|---|---|---|---|---|---|
| FeAlMn-1 | Bal. | 5 | 30 | 0.3 | 0.1Nb |
| FeAlMn-2 | Bal. | 8 | 30 | 1.0 | |
| FeAlMn-3 | Bal. | 10 | 20 | 1.0 | |
| FeAlMn-4 | Bal. | 5 | 20 | 1.0 | |
| FeAlMn-5 | Bal. | 8.5 | 30.1 | 0.88 | |
| FeAlMn-6 | Bal. | 8 | 30 | 1.0 | |
| FeAlMn-7 | Bal. | 6.72 | 31.28 | 0.55 | |
| FeAlMn-8 | Bal. | 8.38 | 29.78 | 1.14 | |
| FeAlMn-9 | Bal. | 7.38 | 27.1 | 0.86 | 0.16Ti+0.10Nb |
| FeAlMn-10 | Bal. | 9.03 | 28.3 | 0.85 | |

Fig. 3

| Code | Mechanical Properties | | | Remarks |
|---|---|---|---|---|
| | U. T. S. (ksi) | Y. S.(ksi) | El (%) | |
| FeAlMn-1 | 95.5 | 51.8 | 43 | J.K. Han etc., Material science & Engineering, 91, 1987, pp73~79 |
| FeAlMn-2 | 129 | 71.7 | 54 | R. Wang etc., Metal Progress, March 1983, pp72~76 |
| FeAlMn-3 | 142.8 | 108.8 | 44 | |
| FeAlMn-4 | 118 | 58.7 | 59 | |
| FeAlMn-5 | 122.4 | 63.8 | 58 | H.J. Lai etc., J. Of Material science, 24, 1989, pp2449~2453 |
| FeAlMn-6 | 129 | 72 | 54 | D.J. Schmatz, Transactions of The ASM, 52, 1960, pp899 |
| FeAlMn-7 | 121.8 | 60.7 | 62 | S.J. Chang etc., Wear science & Engineering, 91, 1987, pp73~79 |
| FeAlMn-8 | 124.7 | 100.3 | 30 | |
| FeAlMn-9 | 185 | 174 | 36.9 | T.F. Liu, U.S. Patent 4968357 |
| FeAlMn-10 | 123 | 89 | 27.8 | |

Fig. 4

| Code | Composition | | | | | | | |
|---|---|---|---|---|---|---|---|---|
| | Fe | Mn | Al | C | Cr | Si | Ti | Mo |
| 1 | Bal. | 26.50 | 6.85 | 0.69 | 5.67 | | | |
| 2 | Bal. | 28.42 | 6.93 | 0.73 | 7.03 | 0.95 | | |
| 3 | Bal. | 30.15 | 6.95 | 0.84 | 8.05 | 1.41 | 2.15 | |
| 4 | Bal. | 29.51 | 7.24 | 0.70 | 6.04 | | | |
| 5 | Bal. | 30.25 | 7.33 | 0.76 | 7.15 | 0.84 | | |
| 6 | Bal. | 29.20 | 7.40 | 0.82 | 8.15 | 1.20 | 3.5 | |
| 7 | Bal. | 27.45 | 7.80 | 0.69 | 5.87 | | 4.01 | |
| 8 | Bal. | 28.52 | 7.77 | 0.75 | 6.98 | 0.88 | | 0.67 |
| 9 | Bal. | 29.53 | 7.75 | 0.81 | 8.07 | 1.02 | 4.89 | |
| 10 | Bal. | 29.13 | 7.25 | 0.81 | 8.92 | 1.38 | 3.01 | 0.95 |
| 11 | Bal. | 29.35 | 7.91 | 0.84 | | | | |
| 12 | Bal. | 29.15 | 9.89 | 1.03 | | | | |
| 13 | Bal. | 28.97 | 7.23 | 0.79 | 3.15 | | | |
| 14 | Bal. | 30.19 | 7.53 | 0.72 | 4.89 | | | |
| 15 | Bal. | 29.39 | 7.25 | 0.79 | 9.56 | | | |

*Code 11, 12, 13, 14 are examples for comparison.

Fig. 7

| Code | Mechanical Properties | | | | | | | Remarks |
|---|---|---|---|---|---|---|---|---|
| | U. T. S. (ksi) | Y. S. (ksi) | El (%) | Impact test(lbft) (room 27℃) | Salt spray (48 hours) | Roughness Ra ( $\mu$ m) | Durability test (3000 particles) | |
| 1 | 105 | 62.3 | 68.5 | 153.0 | Pass | 2.6 | Pass | 1. 950℃ forging. |
| 2 | 105.8 | 63 | 67.4 | 149.6 | Pass | 2.5 | Pass | |
| 3 | 117.4 | 66.2 | 67.1 | 141.5 | Pass | 2.6 | Pass | 2. 1030℃ heat treatment For 2 hours. |
| 4 | 112.9 | 65.3 | 66.8 | 147.7 | Pass | 2.4 | Pass | |
| 5 | 116.7 | 66.7 | 67.2 | 135.2 | Pass | 2.6 | Pass | |
| 6 | 116.3 | 66.5 | 66.7 | 145.3 | Pass | 2.3 | Pass | |
| 7 | 117.1 | 67.3 | 66.4 | 144.8 | Pass | 2.5 | Pass | |
| 8 | 116.4 | 66.8 | 67.3 | 148.7 | Pass | 2.4 | Pass | |
| 9 | 117.3 | 65.1 | 65.8 | 133.4 | Pass | 2.8 | Pass | |
| 10 | 118.2 | 66.2 | 66.3 | 147.9 | Pass | 2.2 | Pass | |
| 11 | 117.8 | 66.7 | 62.9 | 131.8 | Fail | 2.7 | Pass | |
| 12 | 123.8 | 89.7 | 59.4 | 78.1 | Fail | 2.7 | Pass | |
| 13 | 118.1 | 70.2 | 65.1 | 128.1 | Fail | 2.5 | Pass | |
| 14 | 118.1 | 71.4 | 64.5 | 122.3 | Fail | 2.6 | Pass | |
| 15 | 121.5 | 74.4 | 58.5 | 87.3 | Pass | 2.6 | Pass | |

*Code 11, 12, 13, 14, 15 are examples for comparison.

Fig. 8

For 2 hours.

| | Mechanical Properties | | | | | | | |
|---|---|---|---|---|---|---|---|---|
| Code | U. T. S. (ksi) | Y. S. (ksi) | El (%) | Impact test(lbft) (room 27℃) | Salt spray (48 hours) | Roughness Ra ( $\mu$ m) | Durability test (3000 particles) | Remarks |
| 1 | 104.8 | 62.1 | 75.9 | 142.8 | Pass | 2.1 | Pass | 1. 850℃ forging. |
| 2 | 105.5 | 63.6 | 75.1 | 149.4 | Pass | 2.3 | Pass | |
| 3 | 116.2 | 65.8 | 74.7 | 151.8 | Pass | 2.2 | Pass | 2. 1030℃ heat treatment |
| 4 | 112.4 | 65.1 | 74.2 | 145.4 | Pass | 2.2 | Pass | For 12 hours. |
| 5 | 116.1 | 66.5 | 73.7 | 153.8 | Pass | 2.3 | Pass | |
| 6 | 115.7 | 66.3 | 75.2 | 145.3 | Pass | 2.3 | Pass | |
| 7 | 116.3 | 66.8 | 76.9 | 144.4 | Pass | 2.2 | Pass | |
| 8 | 115.5 | 66.5 | 77.8 | 148.2 | Pass | 2.1 | Pass | |
| 98 | 116.3 | 64.8 | 76.1 | 158.5 | Pass | 2.2 | Pass | |
| 10 | 117.6 | 65.9 | 76.8 | 148.3 | Pass | 2.2 | Pass | |

Fig. 10

LOW DENSITY AND HIGH DUCTILITY ALLOY STEEL FOR A GOLF CLUB HEAD

BACKGROUND OF THE INVENTION

1. Field of the Invention

The present invention relates to an alloy for use in making of golf clubs, particularly to an alloy with low density, high ductility and high resistance to corrosion.

2. Description of Related Art

An alloy is a mixture of metals, such as a metal mixed with additions of metals or sub-metals for various special purposes. When a metal is mixed with other metals or sub-metals, its mechanical properties, such as the melting temperature, strength, ductility, electrical resistance, thermal conductance, heat treatment properties, resistance to corrosion and magnetic properties are all promoted.

A set of golf clubs generally comprises woods, irons, pitching wedges, sand wedges, putters, etc. The iron club has a shorter striking distance but gives better good controllability and a higher striking height than the wood club has. In recent years, the iron club has been designed to have a hollow club head in order that the iron club may possess the advantages of the wood club.

With reference to the table in FIG. 1, two manufacturing methods of the head of the golf club are listed; one of them is precision lost-wax casting and the other one is forging. Besides the methods listed in the table of FIG. 1, some iron club heads are finished by surface plating, such as nickel-plating, cobalt-plating, etc. and paneling. Among these methods, the method of the precision lost-wax casting has the lowest manufacturing cost, however the method of the forging has more advantages than the method of precision casting, which can be seen from the comparison in the table of FIG. 1. The mechanical properties of the precision lost-wax casting and the forging are listed in the table of FIG. 2.

The major object of the designing of the golf club is to improve the controllability and stability of striking via good striking points, and the designing has following tendencies:

1. the heads of the clubs are enlarged in order to increase sweet spots and the probability of successful striking; the volume of the woods can be from 280 cc to 310 cc, and even to 350 cc, and the irons also have some oversized features.
2. the center of gravity of the club head is lowered in order to obtain a very stable striking of the ball, good striking points and long striking distance.
3. the shape of the club head is designed to have a strengthened club face with low air drag.

Since the club heads have a variety shapes, an alloy metal is a popular material for manufacture thereof, particularly an alloy which combines high strength with high ductility and resistance to corrosion. However, the alloys which are used to make club head at present do not satisfy all the requirements of the club head. For example, titanium alloyed with stainless steel has good resistance to corrosion from a damp or salty atmosphere, however its ductility and impact value are not good enough; the 304 stainless steel has an elongation of 40%~60%, however its strength is not enough. The S25C with a tensile strength of 75 ksi~85 ksi and an elongation of 30%~35% is the best material for use in forging of a club head, however, its resistance to corrosion is a little insufficient.

The research of the golf materials shows that if an alloy for heads of golf clubs has low density, high ductility and toughness, then the head of the club may be designed with a larger volume, and also the controllability and striking stability of the club will be increased. Presently, manufacturers of golf clubs have a common opinion that the best alloy for the golf club irons should have a tensile strength about 80 ksi to 120 ksi, which is 1.0 to 1.5 times of the tensile strength of the soft iron used for forging, an elongation over 40% and the higher the better, a density below 7.9 g/cm$^3$, and a good resistance to the corrosion.

It has been found that mechanical properties can be promoted by controlling the contents and by performing heat treatment to obtain high strength and toughness, good resistance of low or high temperature, and resistance to the corrosion. The following papers have described these characteristics in detail.

"the Structure and Properties of Austenitic Alloys Containing Aluminum and Silicon" by D. J. Schmatz, Trans. ASM., vol. 52, p. 898, 1960; "Phase Transformation Kinetics in Steel 9G28Yu9MVB" by G. B. Krivonogov et al., Phys. Met. & Metallog, vol. 4, p. 86, 1975; "An Austenitic Stainless Steel Without Nickel or Chromium" by S. K. Banerji, Met. Prog, p. 59, 1978; "Phase Decomposition of Rapidly Solidified Fe—Mn—Al—C Austenitic Alloys" by J. Charles et al., Met. Prog., p. 71, 1981; "Development of Oxidation Resistant Fe—Mn—Al Alloys" by J. Garcia, et al., Met. Prog., p. 47, 1982; "New Stainless Steel Without Nickel or Chromium for Alloys Applications" by R. Wang, Met. Prog, p. 72, 1983; "An Assessment of Fe—Mn—al Alloys as Substitutes for Stainless Steel" by J. C. Benz et al., Journal of Metals, p. 36, 1985; "New Cryogenic Materials" by J. Charles et al., Met. Prog, p. 71, 1981; "TEM Evidence of Modulated Structure in Fe—Mn—al—C Alloys" by K. H. Ham, Scripta Metall, vol. 20, p 33, 1986; Electron Microscope Observation of Phase Decompositions in an Austentic Fe-8.7 Al-29.7 M-1.04 C Alloy" by S. C. Tjong, Mater. Char, vol. 24, p. 275, 1990; "Grain Boundary Precipitation in an Fe-7.8 Al-1.7 Mn-0.8 Si-1.0 C Alloy" by C. N. Hwang et al., Scripta Metall, vol. 28, p109, 1993; "Hot-Rolled Alloy Steel Plate" by T. F. Liu U.S. Pat. No. 4,968,357, 1990.

Reviewing the above noted references, it can be found that in the Fe—Al—Mn—C based alloys, manganese content is added to stabilize the austenite structure and retain an FCC structure under a room or lower than room temperature, which is beneficial to enhance the workability and ductility of the alloy. An aluminum content has a strong effect on oxidation resistance. A carbon content mainly helps precipitation of strengthening elements when the alloy is quenched rapidly after a solution heat treatment at a temperature from 1050° C. to 1200° C., and then aged at a temperature from 450° C., to 750° C. The alloy has a mono austenite structure during the quenching, and the fine $(Fe, Mn)_3AlC_x$ κ carbides are precipitated coherently within the austenite matrix during the aging. Additionally, after a lengthy aging, phase decomposition like $\gamma \rightarrow \alpha + \beta\text{-Mn}$ or $\gamma \rightarrow \alpha + \beta\text{-Mn} + \kappa$ is produced on the grain boundary of the alloy dependent on its chemical composition. The coarse precipitates of β-Mn will deteriorate the ductility of the alloy. Consequently, to obtain carbides precipitated coherently within the austenite matrix and without the coarse β-Mn being precipitated therein is an important method for the alloy to possess a satisfactory strength and ductility.

It is found that the Fe—Al—Mn based alloys mainly consisting of iron, 5 to 12 wt % aluminum, 20 to 35 wt % manganese, and 0.3 to 1.3 wt % carbon, and after being solution heat treated, quenched and aged, will have different mechanical properties dependent on their chemical compositions, the tensile strength has a range of 80 ksi to 200 ksi, the yield strength has a range from 60 ksi to 180 ksi and the elongation has a range from 62% to 25%. As shown in the tables of FIG. 3 and FIG. 4, the chemical compositions and mechanical properties of the typical Fe—Al—Mn alloys, which have been studied by experts in this field, are listed for comparison.

The inventor has worked on the analysis and study of the Fe-10 wt %, Al-30 wt %, Mn-1 wt %, C alloy and the Fe-8 wt %, Al-30 wt %, Mn-0.8 wt %, C alloy. The study proves that after being heat treated at a temperature of 1100° C. for 0.5 to 2 hours, the Fe-10 wt %, Al-30 wt %, Mn-1 wt %, C alloy has its hardness value from $Hr_b$ 82.7 to 88.9, tensile strength from 111 ksi to 124 ksi, yield strength from 79.7 ksi to 97 ksi, elongation from 58.9% to 63.3%, the Hall-Petch relationship between the tensile strength ($\sigma$) and the grain size (d): $\sigma=68.72+21.2\times d^{-0.46}$, a metallograph as shown in FIG. 5, and an unsatisfactory resistance to the air corrosion after having been tested for 48 hours by exposure to salt spray. Other experts have also studied to prove that after being forged at temperatures from 1050° C. to 1200° C., the Fe-10 wt %, Al-30 wt %, Mn-1 wt %, C alloy has a surface roughness of Ra=3.1 to 5.9 $\mu$m, and a metallograph as shown in FIG. 6. After being heat treated at a temperature of 1100° C. for 0.5 to 2 hours, the Fe-8 wt %, Al-30 wt %, Mn-0.8 wt %, C alloy has its tensile strength from 111 ksi to 120 ksi, yield strength from 71.1 ksi to 8301 ksi, elongation from 58.5% to 64.7%, the Hall-Petch relationship between the tensile strength ($\sigma$) and the grain size (d) is $\sigma=68.72+21.2\times d^{-0.46}$, and an unsatisfactory resistance to air corrosion after having been tested for 48 hours by exposure to salt spray. Further experts have also studied to prove that after being forged at temperatures between 1050° C. to 1200° C., the Fe-8 wt %, Al-30 wt %, Mn-0.8 wt %, C alloy has a surface roughness of Ra=3.2 to 5.7 $\mu$m.

The characteristic of the invention is to produce an alloy for a head of a golf club by suitable addition of alloying elements and by controlling a heat treatment condition. The alloy of the invention has a low density (density within 6.78 to 7.05 g/cm$^3$), a high ductility (elongation above 65%), a tensile strength within 80 ksi to 120 ksi, a yield strength within 55 ksi to 70 ksi and high resistance to corrosion via humidity. In accordance with the present invention, the mechanical properties of the alloy for heads of golf clubs are different to those of the other recently developed alloys and more in conformity with the requirement of high strength, high ductility and resistance to corrosion of the heads of golf clubs.

SUMMARY OF THE INVENTION

The object of the present invention is to provide a low density and high ductility alloy for making a golf club head, the alloy consisting essentially of 25 to 31 wt % manganese, 6.3 to 7.8 wt % aluminum, 0.65 to 0.85 wt % carbon, and 5.5 to 9.0 wt % chromium, and the balance being iron. Addition elements 0.8 to 1.5 wt % silicon, 2.0 to 5.0 wt % titanium, or 0.5 to 1.0 wt % molybdenum are optionally added to the alloy of the invention. Due to the addition of chromium, titanium and molybdenum, the alloy of the invention has a good resistance to corrosion. A good finished surface quality is obtained after the alloy is forged at a temperature from 800° C. to 1050° C. Furthermore, a combination of high ductility and high tensile strength is obtained after the alloy has been treated at a temperature from 980° C. to 1080° C. for 1 to 24 hours. Therefore the alloy with low density, high strength, high ductility, good resistance to corrosion, and a good surface finish quality is obtained to satisfy the requirements of the heads of golf clubs.

The detailed features of the present invention will be apparent in the detailed description with appropriate reference to the accompanying drawings.

BRIEF DESCRIPTION OF THE DRAWINGS

FIG. 1 is a comparison table showing features of manufacturing methods of the precision lost-wax casting and the forging of heads of golf clubs;

FIG. 2 is a comparison table showing mechanical properties of conventional alloys for heads of golf clubs;

FIG. 3 is a table of chemical compositions of the typical Fe—Al—Mn alloys which are published up to present;

FIG. 4 is a comparison table showing mechanical properties of the typical Fe—Al—Mn alloys which are published up to present;

FIG. 7 is a table of chemical compositions of embodiments of the alloy for heads of golf clubs in accordance with the invention;

FIG. 8 is a first table of mechanical properties of the embodiments of the alloy for heads of golf clubs in accordance with the invention;

FIG. 10 is a second table of mechanical properties of the embodiments of the alloy for heads of the golf clubs in accordance with the invention;

DETAILED DESCRIPTION OF THE PREFERRED EMBODIMENT

Figure 5:
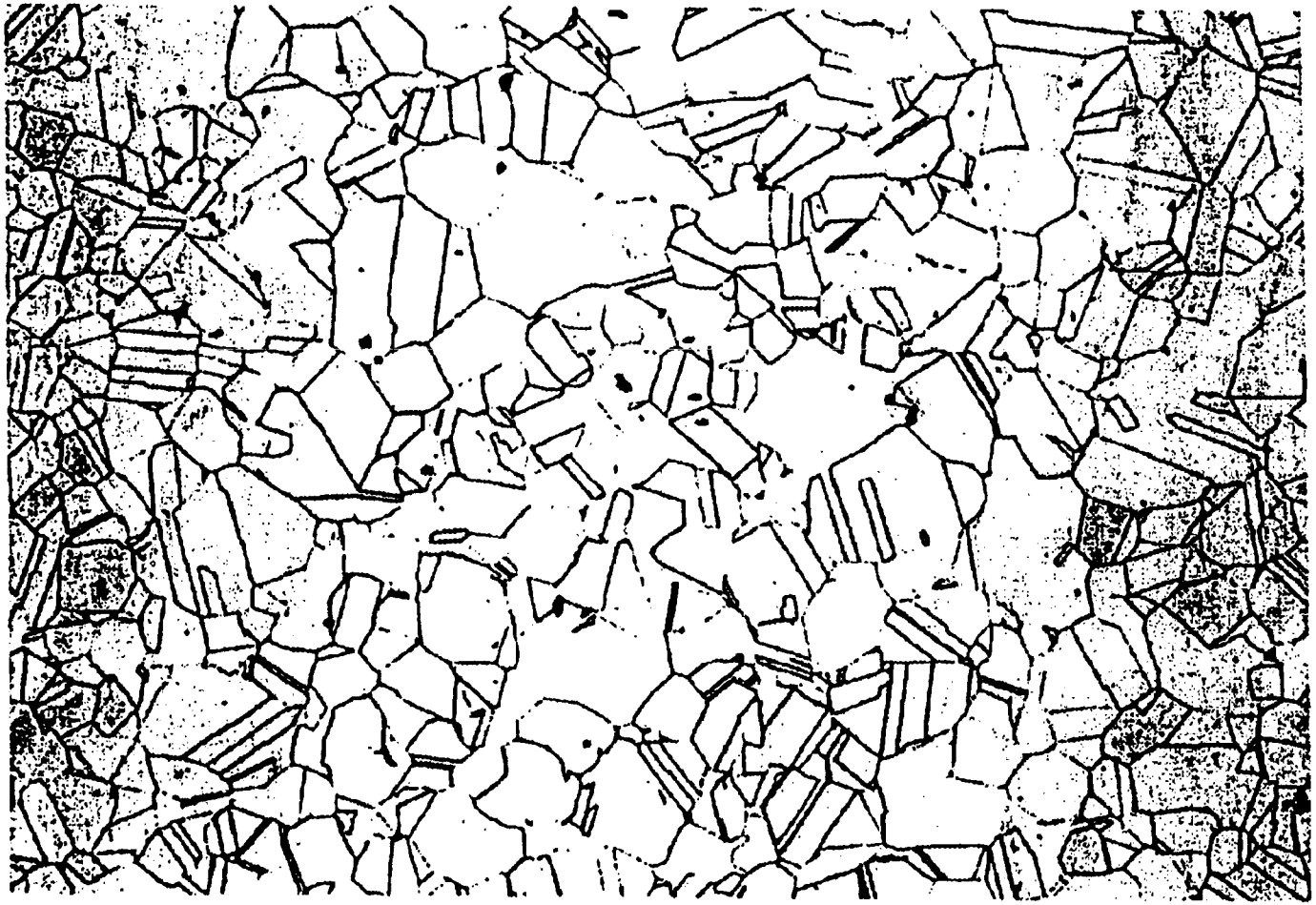
FIG. 5 is a metallograph of an Fe—Al—Mn alloy after being heat treated.
Figure 6:
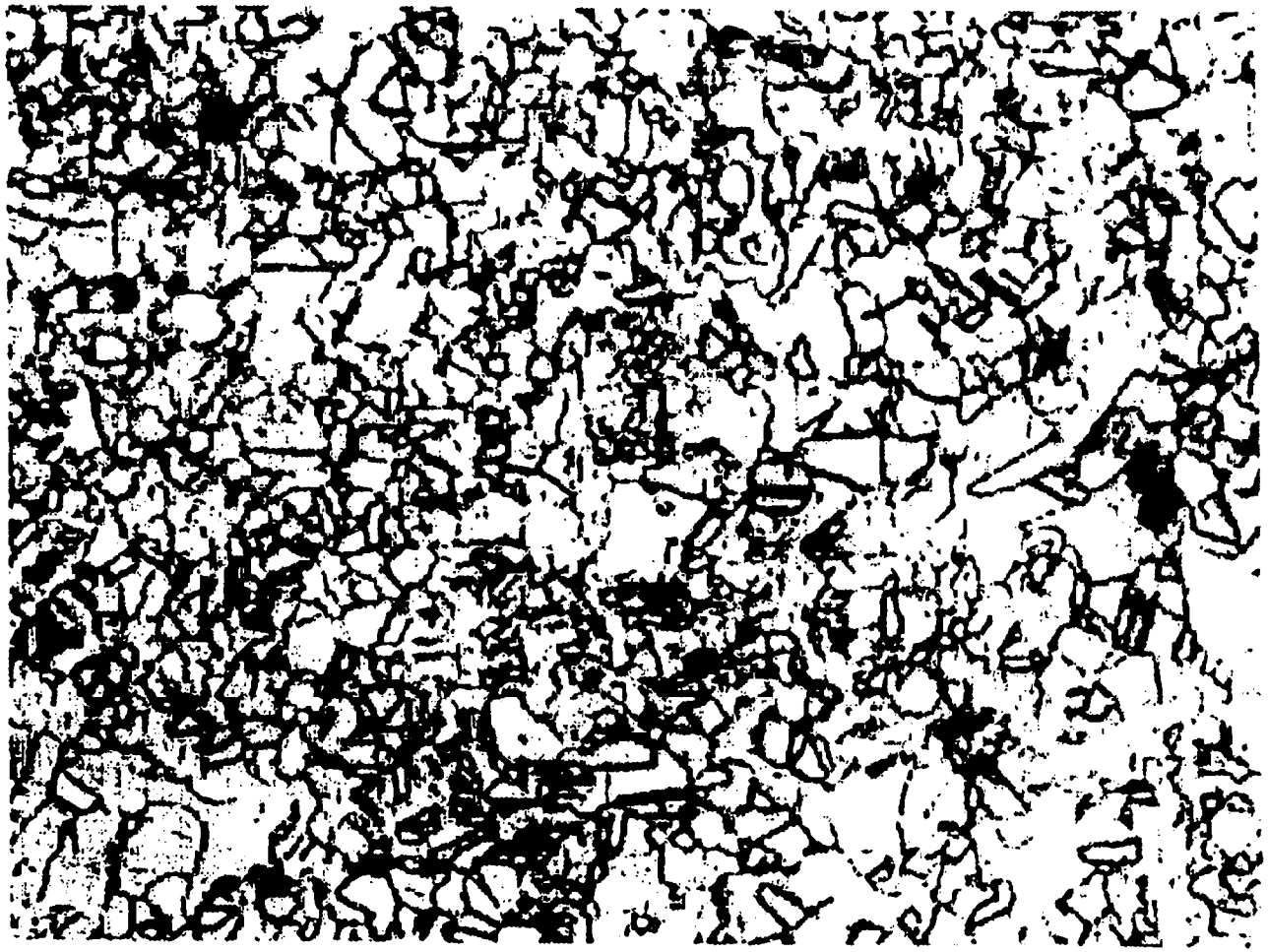
FIG. 6 is a metallograph of an Fe—Al—Mn alloy after being forged.

The present invention relates to an alloy for heads of golf clubs, particularly to an alloy essentially containing 25 to 31 wt % manganese, 6.3 to 7.8 wt % aluminum, 0.65 to 0.85 wt % carbon, and 5.55 to 9.0 wt % chromium, and the balance being iron. Optionally, 0.8 to 1.5 wt % silicon, 2.0 to 5.0 wt % titanium and 0.5 to 1.0 wt % molybdenum may be added.

Alloys from codes 1 to 10 listed in the table of FIG. 7 have their chemical compositions within the range of the present invention, and alloys from codes 11 to 15 are used for comparison.

Referring to FIG. 8, the Fe-26.50 wt %, Mn-6.85 wt %, AL-0.69 wt %, C-5.67 wt %, Cr alloy of code 1 is heat treated at a temperature of 1030° C. for 2 hours to obtain a tensile strength of 105 ksi, a yield strength of 62.3 ksi, an elongation of 68.5% and a value 153.0 lb-ft of an impact test held at room temperature. The alloy is then forged at a temperature of 950° C. to obtain a surface roughness of 2.63 $\mu$m.

Now referring to FIG. 10, the duration of heat treatment of the Fe-26.50 wt %, Mn-6.85 wt %, Al-0.69 wt %, C-5.67 wt %, Cr alloy of code 1 is prolonged to 12 hours, and the alloy of the code 1 is treated at a temperature of 1030° C. for 12 hours to obtain a tensile strength of 104.8 ksi, a yield strength of 62.1 ksi, an elongation of 75.9% and a value 142.8 lb-ft of an impact test performed at room temperature, and then forged at a temperature of 850° C. to obtain a surface roughness of 2.11 μm. The head of club made from the above described alloy and manufactured by the method as described herein has successfully undergone a 48-hour salt spray test and a 3000-impact durability test.

By the same principle, the alloys of codes 2 to 10 with chemical compositions within the range of the present invention are heat treated at a temperature of 1030° C. for 2 to 12 hours to obtain a tensile strength within 104.8 ksi to 118.2 ksi, a yield strength within 62.1 ksi to 68.5 ksi, an elongation within 65.8% to 77.8%, a value from an impact test within 135.2 to 158.5 lb-ft, and a surface roughness below 2.8 μm. The heads of the clubs successfully underwent both 48-hour salt spray tests and 3000-impact durability tests.

Alloys having no chromium or containing chromium below 5.5 wt %, for example, the alloys of codes 11 and 12 which have no chromium added therein, or the alloy of code 13 which has 3.15 wt % chromium added therein, or the alloy of code 14 which has 4.89 wt % chromium added therein, all failed the 48-hour salt spray test, even though their mechanical properties are in conformity with the requirements of the present invention. In other words, these alloys must be coated with an electroplated layer to obtain a satisfactory endurance of the salt spray test.

Figure 9:
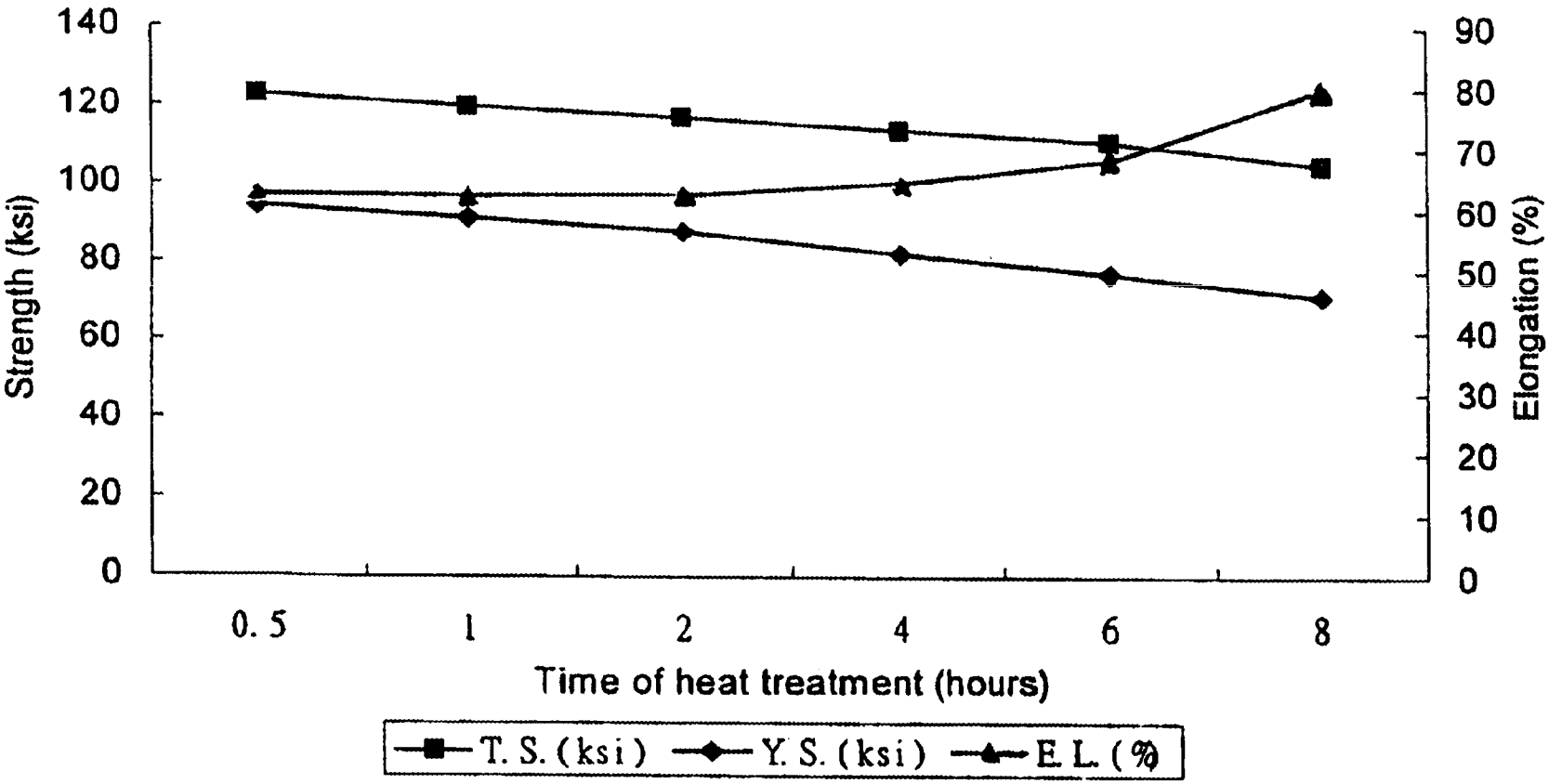
FIG. 9 is a first chart showing the relationship between the duration of an aging process to the tensile strength, yield strength and elongation of the alloy of the invention.
Figure 11:
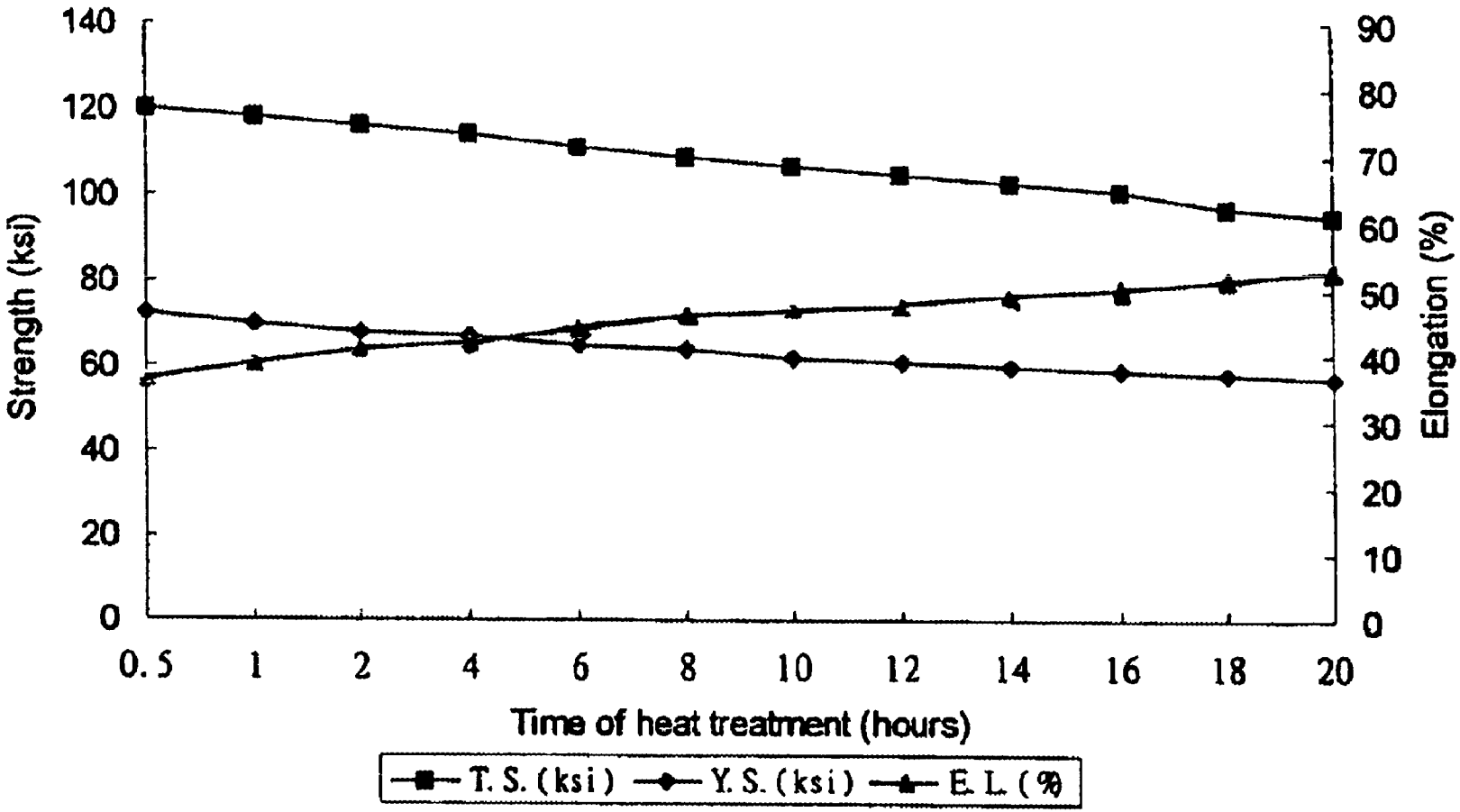
FIG. 11 is a second chart showing the relationship between the duration of the aging process to the tensile strength, yield strength and elongation of the alloy of the invention.

If the alloys within the range of the invention are hot forged at a temperature from 800° C. to 1050° C. and heat treated at a temperature from 980° C. to 1080° C. for 1 to 4 hours, the elongation of the alloy will reach to above 65% as shown in the tables of FIGS. 8 and 9. If the duration of the heat treatment is prolonged to 4 to 24 hours, the elongation of the alloys reaches to above 70% as shown in the tables of FIGS. 10 and 11. Additionally, it is found that the elongation of the alloy of code 1 is substantially stable, but its yield strength becomes lower than 54.81 ksi which is below the desired 55 ksi, when the alloy has been heat treated at a temperature of 1030° C. for 24 hours. Therefore, the alloy of the invention must be heat treated for no more than 24 hours to obtain the required yield strength range.

Figure 12:
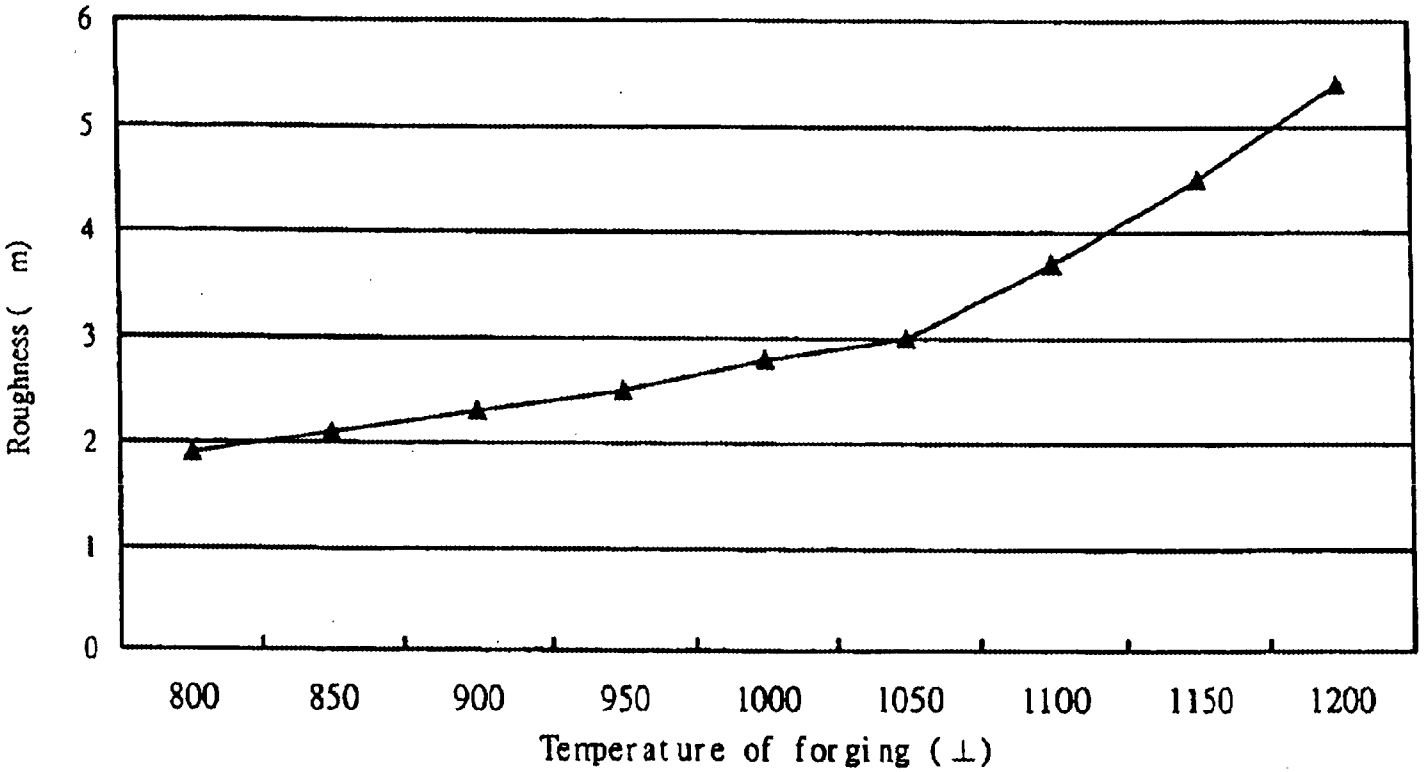
FIG. 12 is a chart showing the relationship between the temperature of forging to the surface roughness of the alloy of the invention.

FIG. 12 shows that the roughness of the alloy of code 1 is increased from 1.9 μm to 5.7 μm along with the increasing of the temperature for the hot forging from 800° C. to 1200° C. Therefore the alloy for heads of clubs must be hot forged below the temperature of 1050° C. to obtain the surface roughness Ra below 3 μm.

In accordance with the present invention, the chemical composition of the alloy should be limited, and the reasons are as follows:

Manganese

Manganese normally coexists with iron. Since manganese tends to combine with sulfur, the hot brittleness caused by the sulfur can be eliminated. Manganese also helps elimination of oxidates in the alloy. In the high-carbon steel, manganese is combined with carbon to be Mn3C, and with Fe3C to be (Fe, Mn)3C to increase the alloy's strength and hardness. When the alloy has the manganese content below 25 wt %, coarse iron grains are produced in the alloy during the manufacturing, which is not beneficial for the workability and ductility of the alloy. When the alloy contains manganese content above 31 wt %, a large amount of the β-Mn phase is precipitated on the grain boundary, which results in brittleness of the alloy. Consequently the manganese content of the alloy of the present invention is strictly limited to between 25 wt % to 31 wt %.

Aluminum

Aluminum content has a deoxydation effect, which not only depresses the growing of crystals to disperse the oxidates and nitrides, but is also beneficial to increasing the ductility, workability and toughness of the alloy. When the aluminum content in the alloy is below 6.3 wt %, the yield strength of the alloy will be less than the desired 55 ksi, and when the aluminum content exceeds about 7.8 wt %, the yield strength of the alloy will be more than the desired 70 ksi. Therefore, the aluminum content should be limited within the range of 6.3 wt % to 7.8 wt %.

Carbon

In addition to the effect of precipitating carbides, carbon content works as a strengthening element to enhance the austenite structure. Coarse iron gains are reduced and the austenite structure is stabilized along with the increasing of the carbon content. When the carbon content in the alloy exceeds 0.5 wt %, the alloy forms a stable austenite structure. In order to obtain a range of yield strength from 66 ksi to 70 ksi, the carbon content in the alloy of the invention should be strictly limited within a range of 0.65 wt % to 0.85 wt %.

Chromium

With the addition of chromium in the alloy, the alloy possesses not only a good resistance to corrosion and oxidation, but also a good hardness and high temperature strength, and particularly has a significant effect on high steel to increase its durability. When chromium content in the alloy is below 5.5 wt %, the heads made from the alloy fail the salt spray test. When the chromium content in the alloy exceeds 9.0 wt %, the elongation of the alloy is below the desired 65%. According to the experiment results of the invention, the chromium content should be limited within the range of 5.5 wt % to 9.0 wt %. If the chromium content in the alloy is below 5.5 wt %, an electroplating process should be performed to enhance the resistance of corrosion of the alloy.

Silicon

The silicon content added in the alloy eliminates formation of air holes and enhances contractibility and fluidity of the molten alloy steel. However, when the silicon content exceeds 1.5 wt %, the elongation of the alloy is below the desired 65%. Consequently, the silicon content in the alloy of the invention should be limited within a range of 0.8 wt % to 1.5 wt %, which helps in the casting process of the alloy.

Titanium

With addition of titanium content in the alloy, the density of the alloy is reduced and the resistance to corrosion of the alloy is increased. When the titanium content in the alloy is below 2.0 wt %, the effects on density and resistance to corrosion are not appreciable. When the titanium content in the alloy exceeds 5.0 wt %, the ductility of the alloy is reduced. According to the results of the invention, the titanium content within a range of 2.0 wt % to 5.0% wt being added in the alloy is beneficial to reducing density and increasing resistance to corrosion.

Molybdenum

The molybdenum content makes the temperature of coarsening of the austenite matrix to be increased, the hardness layer to be deeper, and eliminates tempering embrittlement. The molybdenum content also causes the alloy's high temperature strength, virtual strength and high temperature hardness to be improved, and the resistance to corrosion is enhanced. The molybdenum combined with carbon forms molybdenum carbides, which improve fluidity of the molten alloy steel. When the molybdenum content exceeds 1.5 wt %, excess precipitates will make the alloy brittle. Consequently, if the molybdenum content of the alloy of the invention is limited within a range of 0.5 wt % to 1.0 wt %, both the castability and fluidity of the alloy benefit, and the resistance to corrosion of the alloy is increased.

Overall, the alloy for heads of golf clubs of the invention should be hot forged at temperature range of 800° C. to 1050° C., whereby the surface of finished products obtains a best surface roughness equal or below 3 $\mu$m. If the alloy is hot worked at a temperature from 1050° C. to 1200° C., the alloy will have a surface roughness higher than 3 $\mu$m in addition to an intensified oxide skin.

The alloy for heads of golf clubs of the invention has the following advantages:

1. Mechanical properties: by controlling contents of aluminum, manganese and carbon, the range of the tensile strength of the alloy is from 80 ksi to 120 ksi, the range of the yield strength of the alloy is from 55 ksi to 70 ksi, and so club heads made from the alloy of the invention possess an ideal strength;
2. Low density: by addition of 6.3 wt % to 7.8 wt % aluminum, or optional addition of 2.0 wt % to 5.0 wt % titanium, the alloy of the invention possesses an FCC structure, consequently the density of the alloy is reduced to within 6.78 to 7.05 g/cm$^3$, and in a same weight standard limitation, the heads made from the alloy of the invention will have a larger volume than the heads made from an alloy with a higher density than the alloy of the invention;
3. High ductility: besides the aluminum content's effects on increasing of ductility of the alloy, the alloy can be treated at temperatures between 980° C. to 1080° C. to obtain an increase of ductility, and if the time of the treatment is prolonged to 4 to 24 hours, the elongation of the alloy is increased to over 70%;
4. Resistance to corrosion: the alloy of the invention includes chromium, titanium and molybdenum content, which is beneficial to increasing resistance to corrosion, and also reduces production cost of the heads of golf clubs.

It is to be understood, however, that the above illustration is only to clarify the feature of the alloy for making heads of golf club of the present invention, and should not be seemed as the scope of the invention.

What is claimed is:

1. A low density and high ductility alloy for heads of golf clubs, the alloy having a tensile strength of at least 80 ksi, an elongation greater than 65%, and consisting essentially of 25 to 31 weight percent manganese, 6.3 to 7.8 weight percent aluminum, 0.65 to 0.85 weight percent carbon, 5.5 to 9.0 weight percent chromium, 0.8 to 1.5 weight percent silicon, 2.0 to 5 weight percent titanium, 0.5 to 1 weight percent molybdenum, and the balance being iron; and being forged at a temperature from 800° C. to 1050° C. to form an entire head of a golf club having a surface roughness below 3 $\mu$m.

2. The low density and high ductility alloy for heads of golf clubs as claimed in claim 1, wherein the alloy is treated at a temperature from 980° C. to 1080° C. for 1 to 24 hours to obtain an elongation about 65%.

3. The low density and high ductility alloy for heads of golf clubs as claimed in claim 1, wherein the alloy is treated at a temperature from 980° C. to 1080° C. for 4 to 24 hours to obtain an elongation about 70%.

* * * * *